United States Patent [19]

Fairbanks

[11] Patent Number: 4,466,476

[45] Date of Patent: Aug. 21, 1984

[54] DECORATIVE FABRIC DRAPERY SYSTEM

[75] Inventor: Lyman N. Fairbanks, Arlington, Va.

[73] Assignee: Kenfair Manufacturing Co., Alexandria, Va.

[21] Appl. No.: 506,856

[22] Filed: Jun. 21, 1983

[51] Int. Cl.[3] ..... A47H 23/02

[52] U.S. Cl. ..... 160/330

[58] Field of Search ..... 160/330, 348, 350, 186, 160/187, 166 R

[56] References Cited

U.S. PATENT DOCUMENTS

| | | | |
|---|---|---|---|
| 3,683,994 | 8/1972 | Eichenlaub | 160/348 |
| 3,851,699 | 12/1974 | Shapiro | 160/166 R |
| 4,083,395 | 4/1978 | Romano | 160/330 |
| 4,165,779 | 8/1979 | Jacobs | 160/348 |
| 4,342,356 | 8/1982 | Sickels et al. | 160/327 |
| 4,385,409 | 5/1983 | File | 160/330 X |

*Primary Examiner*—Peter M. Caun
*Assistant Examiner*—Cherney S. Lieberman
*Attorney, Agent, or Firm*—Mason, Fenwick & Lawrence

[57] ABSTRACT

A fabric drapery system having a unique decorative appearance, by providing a pair of fabric drapery modules to be supported on a conventional drapery traverse rod system or the like, wherein each drapery module comprises three fabric drapery front panels extending the full height of the drapery module to form outwardly facing substantially flat panels bounded laterally by drapery seam formations at their vertical edges with an intervening rearfold panel between each pair of front panels. The middle panel of the three front panels is foldable rearwardly into a collapsed position when the drapery is retracted to opened position while the outermost panels adjacent the middle panel are retained in fully extended flat condition so that the outermost panels of the pair always remain in a common vertical plane, and the intervening rearfold panels remain in folded condition continuously. The three fabric drapery front panels in the fully extended or closed condition of the drapery module pair lie in the common vertical plane occupied by the two outermost front panels, and the middle front panel is of substantially the same horizontal width and vertical height as the two laterally flanking front panels.

15 Claims, 7 Drawing Figures

10
11
12
13
14
15
16
17
17a
17b
18
18a
18b
19
20
21
22
23
23a
25
26a
26b
26c

DECORATIVE FABRIC DRAPERY SYSTEM

BACKGROUND AND OBJECTS OF THE INVENTION

The present invention relates in general to draperies for doors, windows and the like, and more particularly to fabric draperies made in module or plural section form usable in pairs to laterally flank windows, doors, wall spaces, or for other decorative treatment, with or without valances, wherein the pair of drapery modules present in both retracted and extended or closed position at least two vertically elongated flat fabric panels bounded laterally by drapery seams at each vertical edge which remain in a common vertical plane and adjoin collapsible panels of like size which lie in the same common vertical plane in the closed condition of the draperies.

Heretofore, fabric draperies as customarily formed for decorative use in homes, as for example to frame windows, doors, furniture, art works, or for other decorative treatments, customarily are formed of large sheets or webs of fabric which are gathered near the top in pleats to provide the usual undulating or pleated drapery configuration when the draperies are disposed in fully extended or closed condition and which assume the appearance of a closely gathered collection of tight fabric folds in retracted or collapsed condition when drawn to the retracted position adjacent the outer ends of the traverse rod system on which they are mounted.

The present invention is designed to provide a fabric drapery system having a unique decorative appearance, by providing a pair of fabric drapery modules to be supported on a conventional drapery traverse rod system, wherein each drapery module comprises, for example, three fabric drapery panels extending the full height of the drapery module to form outwardly facing substantially flat panels bounded laterally by drapery seam formations at their vertical edges, wherein the middle panel of the three panels is foldable rearwardly into a collapsed position when the drapery is retracted to opened position while at least the outermost panel adjacent the middle panel is retained in fully extended flat condition so that the outermost panels of the pair always remain in a common vertical plane.

Another object of the present invention is the provision of a novel fabric drapery module construction as described in the immediately preceding paragraph, wherein the three fabric drapery panels in the fully extended or closed condition of the drapery module pair lie in the common vertical plane occupied by the two outermost panels, and the middle panel is of substantially the same horizontal width and vertical height as the two laterally flanking panels.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figures 1, 2:
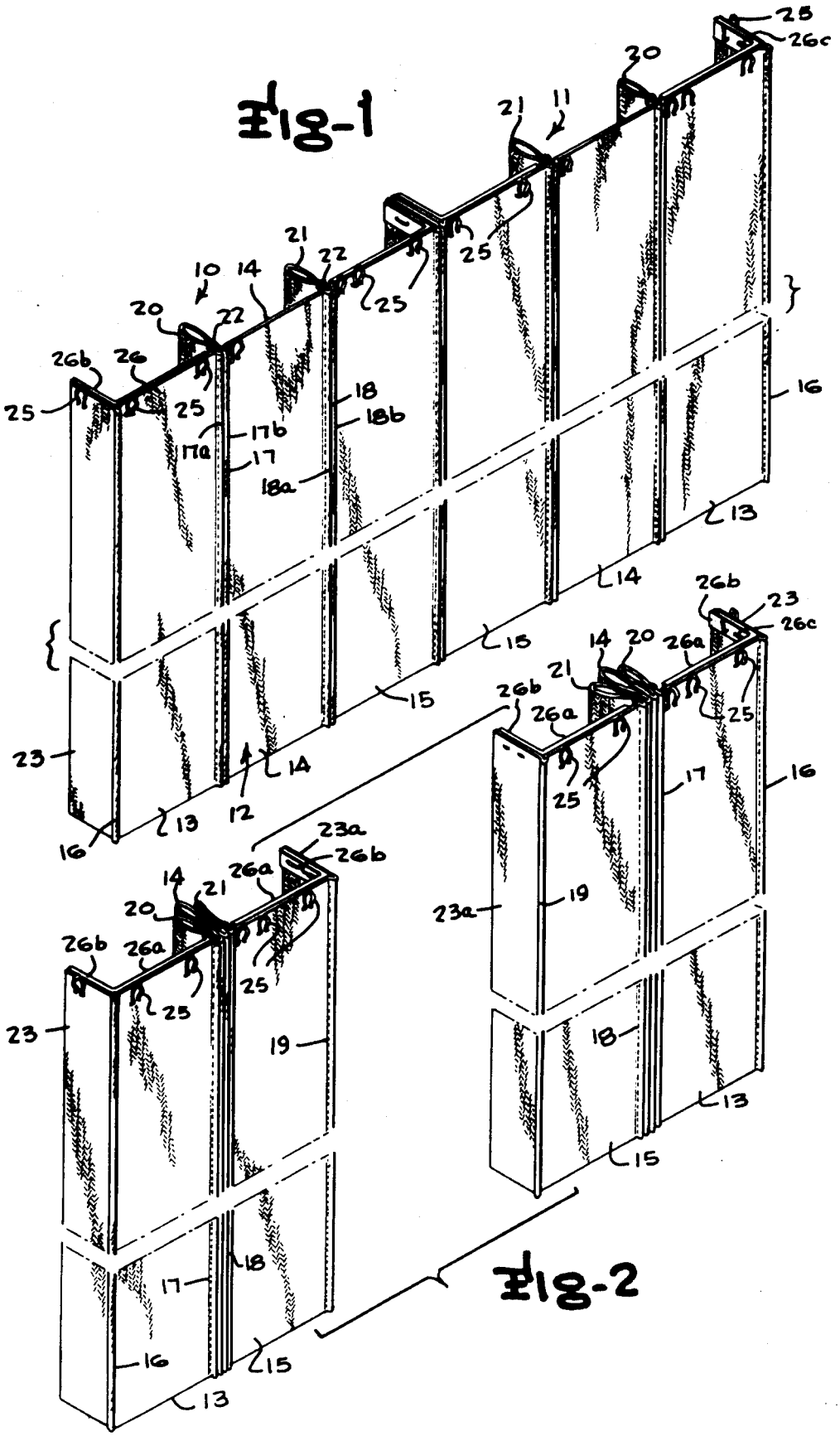
FIG. 1 is a perspective view of a pair of decorative fabric drapery modules forming a first embodiment the drapery system of the present invention, shown in extended or projected condition.
FIG. 2 is a front perspective view thereof, showing the same in retracted or opened condition.

Referring to the drawings, wherein like reference characters designate corresponding parts throughout the several figures, the embodiment of the decorative fabric drapery module system of the present invention illustrated in FIGS. 1–5 comprises a pair of drapery modules or sections indicated by the reference characters 10 and 11, of like construction, each formed in the illustrated embodiment of a single web or sheet of fabric 12 of appropriate color and texture, which may be backed with a lining of plastic heat-sealed to the fabric in the preferred embodiment, to give it the desired stiffness. Each module 10, 11, is formed into three flat, vertically elongated front panels 13, 14, 15 of generally rectangular, vertically elongated form extending the full height of the module or section, bounded along both opposite vertical edges of each panel with drapery seam formations 16, 17, 18, and 19. At the boundaries along the opposite vertical edges of the midpanel or intermediate panel 14, rearwardly extending loop folds 20 and 21 are provided, for example by providing narrower fabric panels between the seam formations **17*a*, 17*b* and 18*a*, 18*b* at the vertical edges of the front panels 13, 14, and 14, 15 respectively collectively making up what appear as double vertical seam formations 17 and 18 at the opposite lateral edges of the midpanel 14**.

In one practical example, the width of the front panels 13, 14 and 15 may be 7½ inches each, and the width of the fold forming panels **20*a*, 21*a* making up the rearwardly extending loop folds 20, 21 may be 6 inches each. The loop folds 20 and 21 may be conveniently formed by clips or pins, as indicated at 22, which close the loop folds 20, 21 at their forwardmost ends adjacent the seam formations 17 and 18. These clips or pins 22 may be provided at the top and bottom and pins or other suitable means, not shown, may be provided at appropriate vertically spaced intervals along the seam formations 17 and 18 to produce the desired appearance. The drapery modules or sections 10, 11 are also provided at the opposite outermost edges with rearwardly projecting narrow end panels or return panels 23, 23*a* extending rearwardly from the opposite end seam formations 16 and 19, for example about 3½ inches, so that the drapery fabric returns to a position substantially flush with the wall on which the traverse rod system, for example as indicated by phantom lines in FIG. 3 at 24, is mounted and corresponding substantially to the extent to which the traverse rod system projects outwardly from the wall. As will be apparent from FIGS. 4 and 5, the return or end panels 23, 23*a* extend rearwardly from the common vertical plane of the front panels 13, 15 substantially the same depth as the loop folds 20, 21. As illustrated, the drapery modules or sections may be conventionally mounted on the traverse rod system by the customary drapery hook pins, as indicated at 25**, which have pointed pin formations to be pinned into the fabric of the draperies and inverted "U" shaped formations which may be interfitted into apertures therefor in the conventional slide loop members of the traverse rod system sliding in the traverse rod trackway.

To maintain the lateral or flanking panels 13, 15 as flat outwardly facing panels in the common plane of the drapery panels 13–15 when the draperies are in retracted or opened condition, substantially "L" shaped stiffener members 26, formed for example of plastic, are secured to the upper edge portions of the outermost front panels 13 and the adjoining rearwardly extending end panels 23, and also to the innermost front panels 15 and their adjoining rearwardly extending panels **23*a*, if present, thereby preventing collapse of the outboard or flanking panels 13, 15 when the traverse rod system is activated to draw the drapes to the collapsed or retracted position. These stiffener members 26 include a front stiffener leg 26*a* and a rearwardly extending stiffener leg 26*b*, which may be secured to the fabric 12 forming the outboard panels 13, 15 in any convenient manner, for example by gripping the relatively thin stiffener legs 26*a*, 26*b* between the pin portion and the hook portion of the hook pins 25 by which the drapery modules are connected to the aperture slide loop members of the traverse rod 24. In the illustrated example, the L-shaped stiffener members 26 are formed with a dimple or indented rib 26*c* at the bend between the legs 26*a*, 26*b* and extending into these legs to lend rigidity to the thin plastic members 26**.

Figure 3:
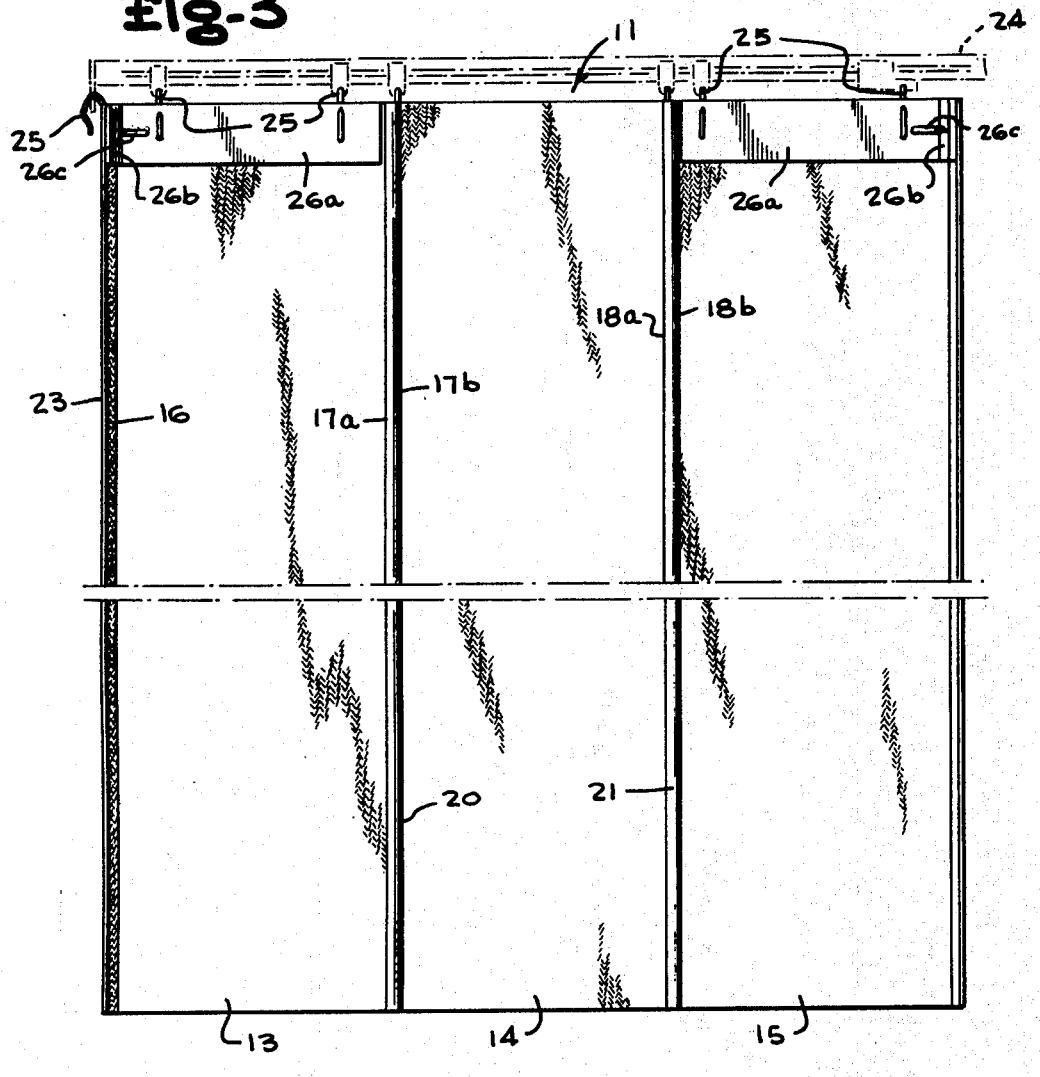
FIG. 3 is a rear elevation view of one such drapery module, showing the same in extended position.
Figure 4:
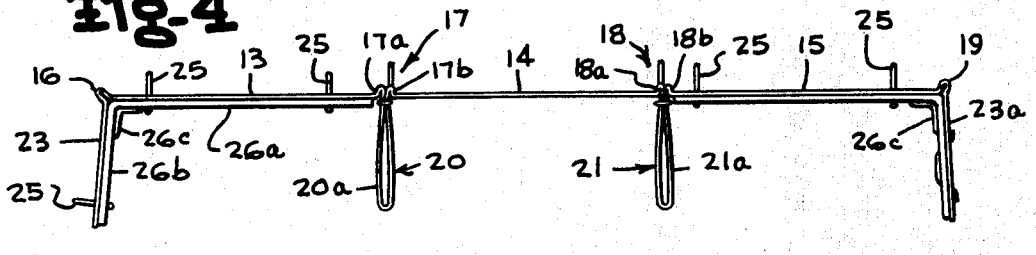
FIG. 4 is a top plan view of one such module, showing the same in extended condition.
Figure 5:
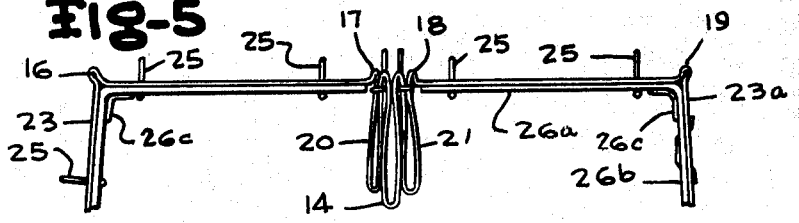
FIG. 5 is a top plan view of the module, showing the same in retracted condition.

When the drapery modules or sections 10, 11 are in the extended or closed condition shown in FIGS. 1, 3 and 4, all three front panels 13, 14 and 15 are of full width and disposed in the common vertical plane presenting an attractive 3 panel appearance for each drapery module or panel. When the modules or sections are withdrawn to retracted or opened condition, shown in FIGS. 2 and 5, the middle front panel 14 of each module or section collapses rearwardly into a rearfold loop folded about its vertical center line, whereby each module assumes the appearance of a 2 panel drapery with each panel of the full width lying in the common vertical plane due to the stiffener members 26.

Figures 6, 7:
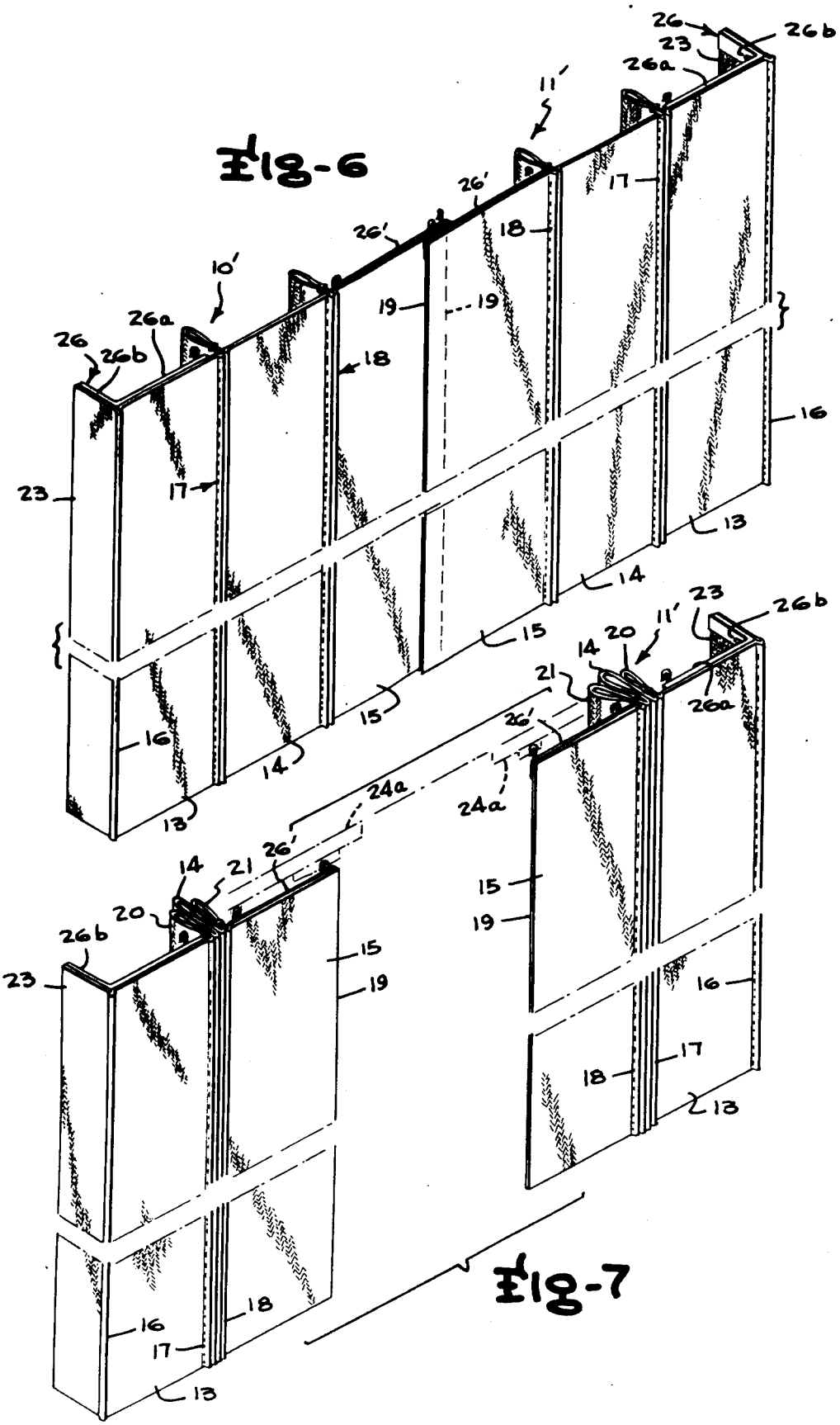
FIGS. 6 and 7 are front perspective views of a second embodiment of the drapery system of the present invention.

A modification or further embodiment of the drapery system using the same fabric construction and configuration is illustrated in FIGS. 6 and 7, but wherein the right angular stiffener members 26 are only used for the outermost front panels of the two drapery modules or sections and a simple straight stiffener strip of any desired material is provided for each innermost front panel of each module or section so that adjacent portions of the innermost front panels of the two modules overlap, for example providing an overlap of about the same as the overlapping traverse rod bars, when the drapery system is in the extended or closed position. As shown in FIGS. 6 and 7, wherein the portions of the drapery modules corresponding to those of the embodiment of FIGS. 1–5 are indicated by the same reference characters, and the two modules or sections are indicated by reference characters 10' and 11', each module or section 10', 11' comprises the same three flat, vertically elongated front panels 13, 14, 15 adapted to be arranged substantially in a common vertical plane and extend the full height of the respective module. The front panels 13, 14, 15, as in the previously described embodiment, are bounded along both opposite vertical edges with drapery seam formations 16, 17, 18, and 19. Narrower fabric panels **20*a*, 21*a* like those of the earlier described embodiment occur between the respective panels 13, 14 and 14, 15 and are secured by clips, pins or other conventional means in rearwardly extending loop folds 20, 21. Rearwardly extending return or end panels 23 are provided at the outermost edges or boundaries of the outermost front panels 13, and stiffener members 26 like those of the previously described embodiment are pinned or otherwise secured at the tops of the outermost front panels 13 and to the adjoining return or end panels 23, but no return or end panels are provided for the innermost front panels 15 of the two modules or sections 10', 11'. Also, a straignt stiffener strip, as indicated at 26' is pinned or otherwise secured to the top of each innermost front panel 15 in this embodiment to retain panels 15 in flat extended vertical planes like the panels 13 and the upper opposite end portions of the panels 15 are pinned by conventional drapery hook pins 25 or the like hooked into appropriate holes of slide loops and in the conventional slide bars, shown in phantom lines at 24*a*, of standard traverse rod systems, whereby the portions hooked to the slide bars are drawn into overlapped condition in the usual operation of traverse rod systems. With this arrangement, the two innermost front panels 15 of the pair of modules or sections 10', 11' will only overlap for a short distance, for example about 3 inches, in the closed or extended position of the drapery system. When the drapery modules or sections 10', 11' of this embodiment are retracted to the open position shown in FIG. 7, the middle front panels 14 of the two modules collapse substantially about the vertical center line of the midpanel 14 to a depth substantially corresponding to that of the end or return panel 23 and the loop folds 20, 21, in similar manner to the first described embodiment of FIGS. 1–5, retracting each module to a condition presenting the appearance of two immediately adjoining full width flat front panels, produced by the adjacent panels 13, 15, for each module or section 10', 11'**.

I claim:

1. A decorative fabric drapery system forming draw drapes arranged as a pair of drapery modules to be supported from a conventional traverse rod mechanism or the like mounted on an adjacent wall surface and movable from extended closed position to retracted open position flanking a wall area to be framed thereby, the drapery modules each comprising an integral fabric web of chosen drapery height formed into three vertically elongated rectangular outwardly facing front panels of a predetermined panel width such that two of such panel widths collectively equal a selected minimum open drapery module span and an intervening rearfold panel between each pair of such front panels, the fabric web for each module also including drapery seam formations laterally bounding said front panels along their full height defining the opposite vertical edges of each front panel, said intervening rearfold panels being of narrower width than said front panels appropriate when folded rearwardly about their vertical center line to extend substantially to said adjacent wall surface, means for securing together opposite vertical edge portions of said respective rearfold panels immediately adjacent and joining said seam formations of the pair of said front panels flanking the same to retain the rearfold panels in such rearwardly folded condition, the middle front panel of said three front panels being connected to the traverse rod system to be folded rearwardly into collapsed position disposing its opposite laterally bounding seam formations in substantially abutting relation when the drapery modules are drawn to retracted open position, and means at the tops of the outermost front panels flanking said middle front panel retaining said outermost front panels continuously in fully extended flat condition so that they always remain in a common vertical plane at both the closed and open positions of the drapery system.

2. A decorative fabric drapery system as defined in claim 1, wherein the three outwardly facing front panels in the extended closed position of the drapery module pair lie in a common vertical plane continuously occupied by the two outermost panels, and said middle panel is of substantially the same horizontal width and vertical height as the two laterally flanking panels.

3. A decorative fabric drapery system as defined in claim 1, wherein each module is provided with a rearwardly extending return end panel extending from the outermost vertical edge seam formation of at least the outermost front panel of each module to a position substantially flush with said adjacent wall surface.

4. A decorative fabric drapery system as defined in claim 2, wherein each module is provided with a rearwardly extending return end panel extending from the outermost vertical edge seam formation of at least the outermost front panel of each module to a position substantially flush with said adjacent wall surface.

5. A decorative fabric drapery system as defined in claim 1, including a horizontally elongated rigid stiffener member having a flat planiform surface portion spanning a horizontal distance equal to said predetermined panel width for said front panels located in rearwardly underlying relation to the uppermost end portion of at least the outermost front panel of each of said modules, and means securing at least the opposite horizontal end portions of said stiffener member for each respective outermost front panel to lateral edge portions of the adjacent front panel near said vertical edges thereof to continuously retain such associated front panel in fully extended substantially flat condition widthwise thereof.

6. A decorative fabric drapery system as defined in claim 2, including a horizontally elongated rigid stiffener member having a flat planiform surface portion spanning a horizontal distance equal to said predetermined panel width for said front panels located in rearwardly underlying relation to the uppermost end portion of at least the outermost front panel of each of said modules, and means securing at least the opposite horizontal end portions of said stiffener member for each respective outermost front panel to lateral edge portions of the adjacent front panel near said vertical edges thereof to continuously retain such associated front panel in fully extended substantially flat condition widthwise thereof.

7. A decorative fabric drapery system as defined in claim 3, including a horizontally elongated rigid stiffener member having a flat planiform surface portion spanning a horizontal distance equal to said predetermined panel width for said front panels located in rearwardly underlying relation to the uppermost end portion of at least the outermost front panel of each of said modules, and means securing at least the opposite horizontal end portions of said stiffener member for each respective outermost front panel to lateral edge portions of the adjacent front panel near said vertical edges thereof to continuously retain such associated front panel in fully extended substantially flat condition widthwise thereof.

8. A decorative fabric drapery system as defined in claim 4, including a horizontally elongated rigid stiffener member having a flat planiform surface portion spanning a horizontal distance equal to said predetermined panel width for said front panels located in rearwardly underlying relation to the uppermost end portion of at least the outermost front panel of each of said modules, and means securing at least the opposite horizontal end portions of said stiffener member for each respective outermost front panel to lateral edge portions of the adjacent front panel near said vertical edges thereof to continuously retain such associated front panel in fully extended substantially flat condition widthwise thereof.

9. A decorative fabric drapery system as defined in claim 1, including a pair of horizontally elongated rigid stiffener members for each module each having a flat planiform surface portion spanning a horizontal distance equal to said predetermined panel width for said front panels located in rearwardly underlying relation to the uppermost end portion of the outermost and innermost front panel of each of said modules, and means securing at least the opposite horizontal end portions of said stiffener members for each respective outermost and innermost front panel to lateral edge portions of the adjacent front panel near said vertical edges thereof to continuously retain such associated front panel in fully extended substantially flat condition widthwise thereof.

10. A decorative fabric drapery system as defined in claim 2, including a pair of horizontally elongated rigid stiffener members for each module each having a flat planiform surface portion spanning a horizontal distance equal to said predetermined panel width for said front panels located in rearwardly underlying relation to the uppermost end portion of the outermost and innermost front panel of each of said modules, and means securing at least the opposite horizontal end portions of said stiffener members for each respective outermost and innermost front panel to lateral edge portions of the adjacent front panel near said vertical edges thereof to continuously retain such associated front panel in fully extended substantially flat condition widthwise thereof.

11. A decorative fabric drapery system as defined in claim 3, including a pair of horizontally elongated rigid stiffener members for each module each having a flat planiform surface portion spanning a horizontal distance equal to said predetermined panel width for said front panels located in rearwardly underlying relation to the uppermost end portion of the outermost and innermost front panel of each of said modules, and means securing at least the opposite horizontal end portions of said stiffener members for each respective outermost and innermost front panel to lateral edge portions of the adjacent front panel near said vertical edges thereof to continuously retain such associated front panel in fully extended substantially flat condition widthwise thereof.

12. A decorative fabric drapery system as defined in claim 7, wherein said stiffener member is an "L" shaped stiffener member having a longer first leg defining said planiform surface portion and having a shorter second leg extending integrally therefrom toward said adjacent wall surface to be secured to said end return panel of the associated module.

13. A decorative fabric drapery system as defined in claim 8, wherein said stiffener member is an "L" shaped stiffener member having a longer first leg defining said planiform surface portion and having a shorter second leg extending integrally therefrom toward said adjacent wall surface to be secured to said end return panel of the associated module.

14. A decorative fabric drapery system as defined in claim 7, wherein said "L" shaped stiffener is a plastic stiffener member wherein said first leg is a substantially flat thin strap-like leg portion and said second leg is of similar configuration extending rearwardly from said first leg, and wherein an indented reinforcing rib formation is provided at the juncture of said legs extending toward each leg to facilitate rigidly maintaining said legs in right angular relation to each other.

15. A decorative fabric drapery system as defined in claim 8, wherein said "L" shaped stiffener is a plastic stiffener member wherein said first leg is a substantially flat thin strap-like leg portion and said second leg is of similar configuration extending rearwardly from said first leg, and wherein an indented reinforcing rib formation is provided at the juncture of said legs extending toward each leg to facilitate rigidly maintaining said legs in right angular relation to each other.

* * * * *